US012760466B2

(12) United States Patent
Yi et al.

(10) Patent No.: US 12,760,466 B2
(45) Date of Patent: Oct. 13, 2026

(54) CLOTHES DRYER

(71) Applicant: Morus Technology(Shenzhen) Co., Ltd., Shenzhen (CN)

(72) Inventors: Er-Xuan Yi, Shenzhen (CN); Guan-Fen Ye, Shenzhen (CN)

(73) Assignee: Morus Technology(Shenzhen) Co., Ltd., Shenzhen (CN)

( * ) Notice: Subject to any disclaimer, the term of this patent is extended or adjusted under 35 U.S.C. 154(b) by 540 days.

(21) Appl. No.: 18/509,775

(22) Filed: Nov. 15, 2023

(65) Prior Publication Data

US 2024/0328064 A1 Oct. 3, 2024

(30) Foreign Application Priority Data

Mar. 30, 2023 (CN) ..... 202310358072.2

(51) Int. Cl.

| | |
|---|---|
| ***D06F 43/08*** | (2006.01) |
| ***D06F 58/04*** | (2006.01) |
| ***D06F 58/20*** | (2006.01) |
| ***D06F 58/38*** | (2020.01) |
| *D06F 103/68* | (2020.01) |
| *D06F 105/32* | (2020.01) |

(52) U.S. Cl.

CPC ..... *D06F 58/20* (2013.01); *D06F 58/38* (2020.02); *D06F 2103/68* (2020.02); *D06F 2105/32* (2020.02)

(58) Field of Classification Search

CPC ..... D06F 43/08; D06F 58/30; D06F 58/20; D06F 58/38; D06F 58/04

USPC ..... 34/131, 607, 132, 77, 76

See application file for complete search history.

(56) References Cited

U.S. PATENT DOCUMENTS

| | | | | |
|---|---|---|---|---|
| 8,978,267 | B2 * | 3/2015 | Krausch | D06F 58/20 34/131 |
| 2011/0154680 | A1 * | 6/2011 | Lee | D06F 58/20 700/275 |
| 2012/0124858 | A1 * | 5/2012 | Yang | D06F 58/26 34/524 |

FOREIGN PATENT DOCUMENTS

| | | | |
|---|---|---|---|
| JP | H0576694 | A | 3/1993 |

* cited by examiner

*Primary Examiner* — Deming Wan

(74) *Attorney, Agent, or Firm* — ScienBiziP, P.C.

(57) ABSTRACT

A clothes dryer includes a drum with a first flow path and a flow guiding component with a second flow path. These paths are fluidly connected. Positioned between the drum and component is a switching valve. This valve comprises an air-exchange chamber with a first and second chamber. The first chamber has a first inlet linked to the second flow path and a first outlet linked to the environment. The second chamber has an inlet connected to the environment and an outlet connected to the first flow path. A through hole exists between both chambers. The sealing assembly includes a driving member and two sealing members. The driver rotates the first sealing member, which can selectively cover the first outlet and through hole, while the second member can cover the second outlet.

20 Claims, 7 Drawing Sheets

CLOTHES DRYER

FIELD

The subject matter herein generally relates to clothes treatment apparatus, and more particularly, to a clothes dryer.

BACKGROUND

Clothes dryers primarily operate in two distinct modes: an internal circulation mode and an external circulation mode. In dryers with the internal circulation mode, the airflow for drying circulates within the dryer. As a result, the drying process is minimally influenced by external temperature and humidity, making such dryers suitable for use in humid seasons. However, the internal circulation mode may need a long time to dry out the clothes since the water vapor in the dryer is difficult to be discharged to the ambient environment. The external circulation mode facilitates exchanging of airflows between the dryer and the ambient environment, and thus a shorter time to dry out the clothes is required. However, the external circulation mode may be affected by external temperature and humidity, making such dryers suited for used in dry weather conditions.

Thus, an airflow exchange valve is mounted into the dryer, which allows the dryer to switch between the above mentioned two modes to meet needs under different weather conditions. However, an existing airflow exchange valve includes an airflow inlet valve and an airflow outlet valve independent from each other. An operation of the airflow inlet valve and an operation of the airflow outlet valve may not be synchronized, as such, the dryer may not be operating efficiently when switching between the internal and the external circulation modes and the circulations may become obstructed.

BRIEF DESCRIPTION OF THE DRAWINGS

Implementations of the present technology will now be described, by way of example only, with reference to the attached figures.

DETAILED DESCRIPTION

Figure 1:
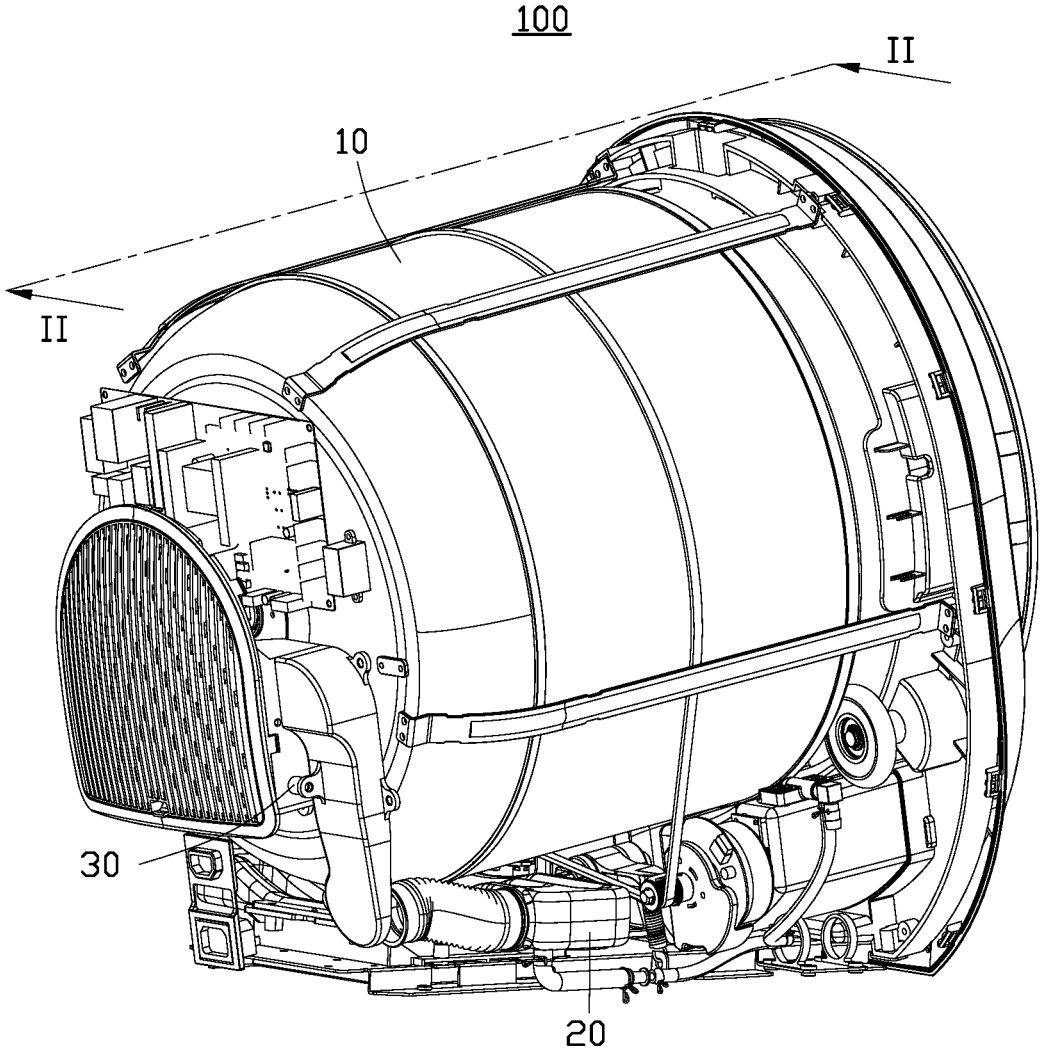
FIG. 1 is a diagrammatic view of a clothes dryer according to an embodiment of the present disclosure.

It will be appreciated that for simplicity and clarity of illustration, where appropriate, reference numerals have been repeated among the different figures to indicate corresponding or analogous members. In addition, numerous specific details are set forth in order to provide a thorough understanding of the embodiments described herein. However, it will be understood by those of ordinary skill in the art that the embodiments described herein can be practiced without these specific details. In other instances, methods, procedures, and members have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

The term "comprising," when utilized, means "including, but not necessarily limited to;" it specifically indicates open-ended inclusion or membership in the so-described combination, group, series, and the like.

Figure 2:
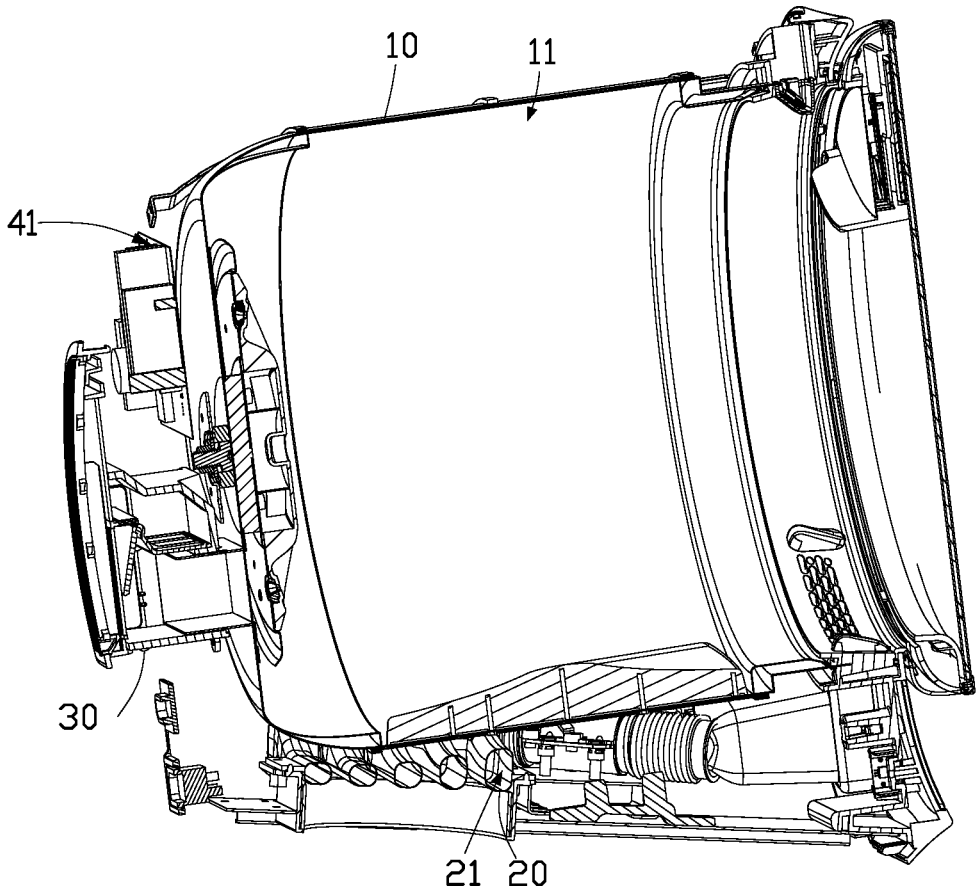
FIG. 2 is a cross-sectional view along a view line II-II of the clothes dryer in FIG. 1.

Referring to FIGS. 1 and 2, a clothes dryer 100 is provided according to an embodiment of the present disclosure. The clothes dryer 100 includes a drum 10, an airflow guiding component 20, and a switching valve 30. The drum 10 is connected to the airflow guiding component 20. The switching valve 30 is configured between the drum 10 and the airflow guiding component 20. The drum 10 defines a first airflow path 11, which may accommodate damp clothes. The airflow guiding component 20 defines a second airflow path 21. The first airflow path 11 is connected to the second airflow path 21, allowing the airflow to circulate within the drum 10 and the flow guiding component 20. The switching valve 30 is connected to the external environment and may introduce external airflow into the first airflow path 11.

Figure 4:
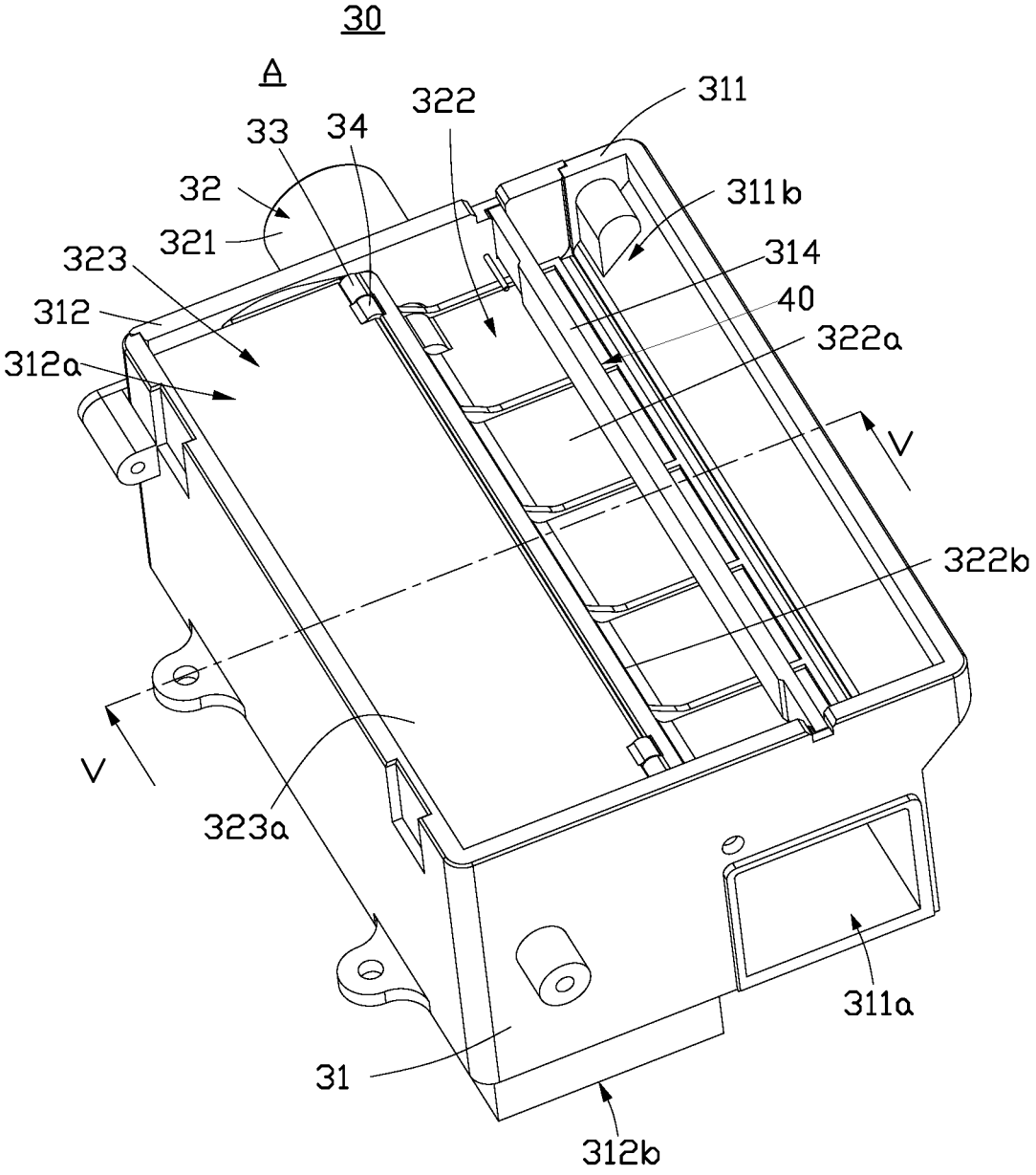
FIG. 4 is a diagrammatic view of a switching valve of the clothes dryer in FIG. 2, the clothes dryer is in a first circulation state.
Figure 5:
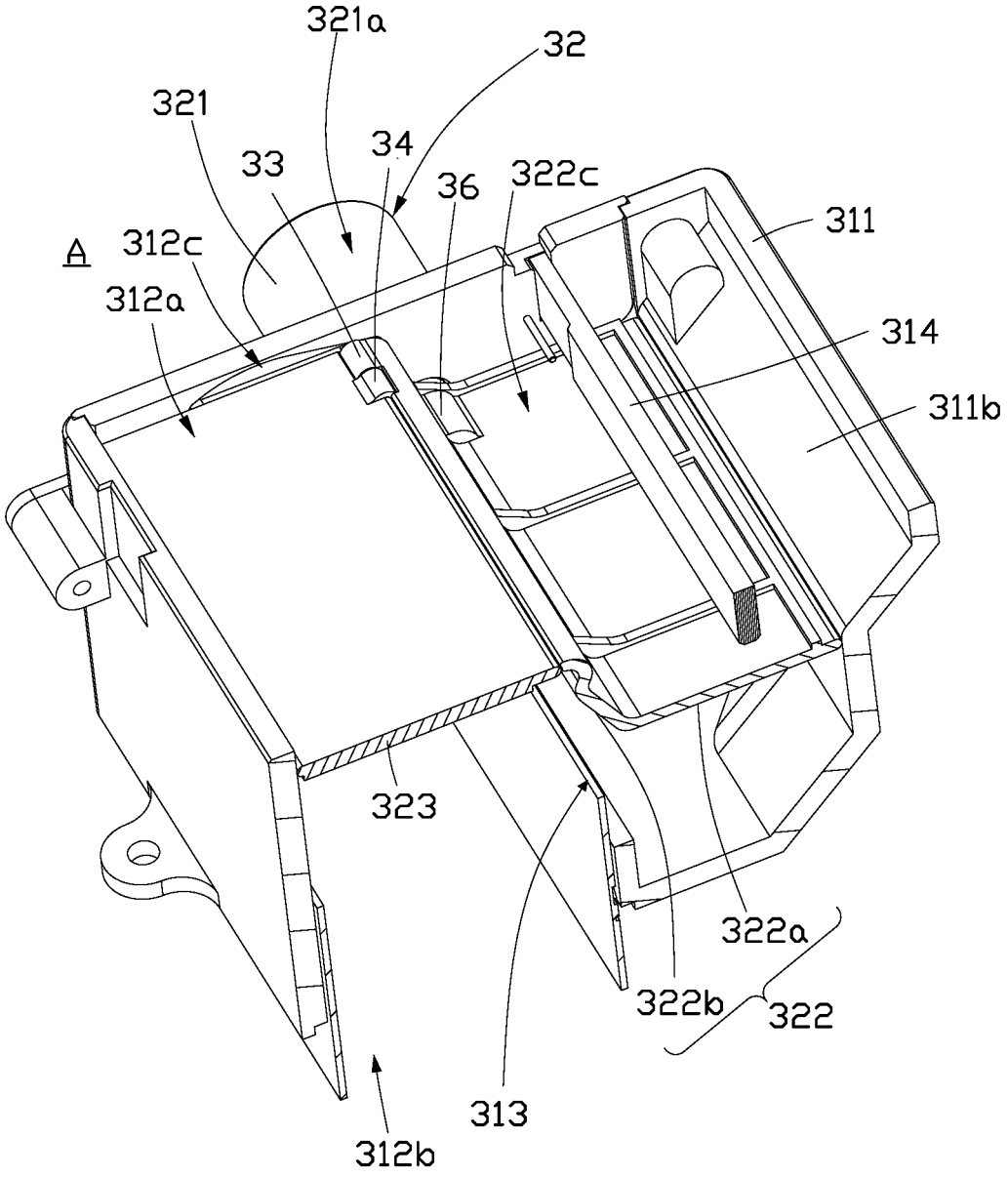
FIG. 5 is a cross-sectional view along a view line V-V of the switching valve in FIG. 4.
Figure 6:
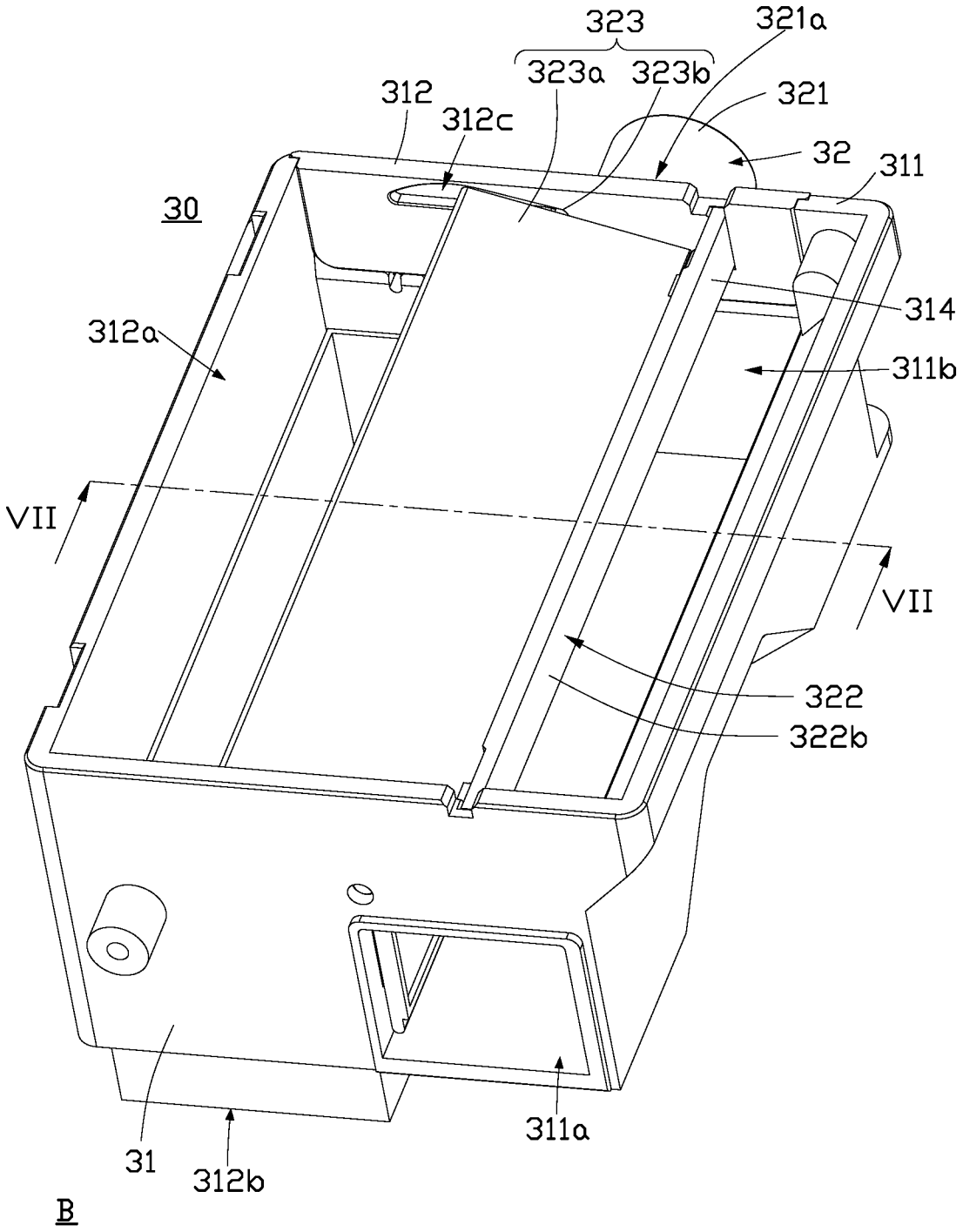
FIG. 6 is a diagrammatic view of the switching valve of the clothes dryer in FIG. 2, the clothes dryer is in second circulation state.

Referring to FIGS. 4, 5 and 6, the switching valve 30 includes an air-exchange chamber 31 and a sealing assembly 32 disposed within the air-exchange chamber 31. The air-exchange chamber 31 includes a first air chamber 311 and a second air chamber 312 connected to the first air chamber 311. A through hole 313 is defined between the first air chamber 311 and the second air chamber 312, allowing the airflow to flow between the first air chamber 311 and the second air chamber 312.

The first air chamber 311 defines a first inlet 311*a* and a first outlet 311*b*. The first inlet 311*a* is connected to the second flow path 21, and the first outlet 311*b* is connected to the external environment. The second air chamber 312 defines a second inlet 312*a* and a second outlet 312*b*. The second inlet 312*a* is connected to the external environment. The second outlet 311*b* is connected to the first flow path 11.

The first inlet 311*a* is staggered from the first outlet 311*b*. The second inlet 312*a* is aligned with the second outlet 312*b*. The first outlet 311*b* and the second inlet 312*a* are arranged side by side. This configuration facilitates the arrangement of the first outlet 311*b* and the second inlet 312*a* on a same side of the drum 10. During installation, a space is only needed between the side of the drum 10 and an installation surface (for example, a wall), thereby simplifying installation requirements and reducing the installation space for the clothes dryer 100.

Referring to FIGS. 4, 5 and 6, the sealing assembly 32 includes a driving member 321, a first sealing member 322, and a second sealing member 323. The driving member 321 is positioned outside the air-exchange chamber 31, and is connected to the first sealing member 322 to rotate the first sealing member 322. The first sealing member 322 is pivotally connected to the second sealing member 323, causing the second sealing member 323 to move when the first sealing member 322 rotates.

The first sealing member 322 selectively covers one of the first outlet 311*b* and the through hole 313. The first sealing member 322 can seal the first outlet 311*b* without sealing the through hole 313 (first circulation state A), or can seal the through hole 313 without sealing the first outlet 311*b* (second circulation state B). The second sealing member 323 selectively covers the second inlet 312*a*, either sealing (first circulation state A) or not sealing the second inlet 312*a* (second circulation state B).

Referring to FIGS. 4 to 7, during the rotation of the first sealing member 322 by the drive member 321, the second sealing member 323 also moves, allowing the clothes dryer 100 to switch between the first circulation States A and the second circulation state B.

Referring to FIGS. 4 and 5, in first circulation state A, the first sealing member 322 covers the first outlet 311*b* without sealing the through hole 313, while the second sealing member 323 seals the second inlet 312*a*. The airflow in the first flow path 11 or the second flow path 21 cannot exchange with the airflow in the external environment. The airflow from the second flow path 21 can only enter the first chamber 311 via the first inlet 311*a*, then move from the first chamber 311 to the second chamber 312 via the through hole 313, and subsequently flow from the second chamber 312 to the first flow path 11 through the second outlet 312*b*. In the first circulation state A, the airflow circulates only within the clothes dryer 100.

Figure 7:
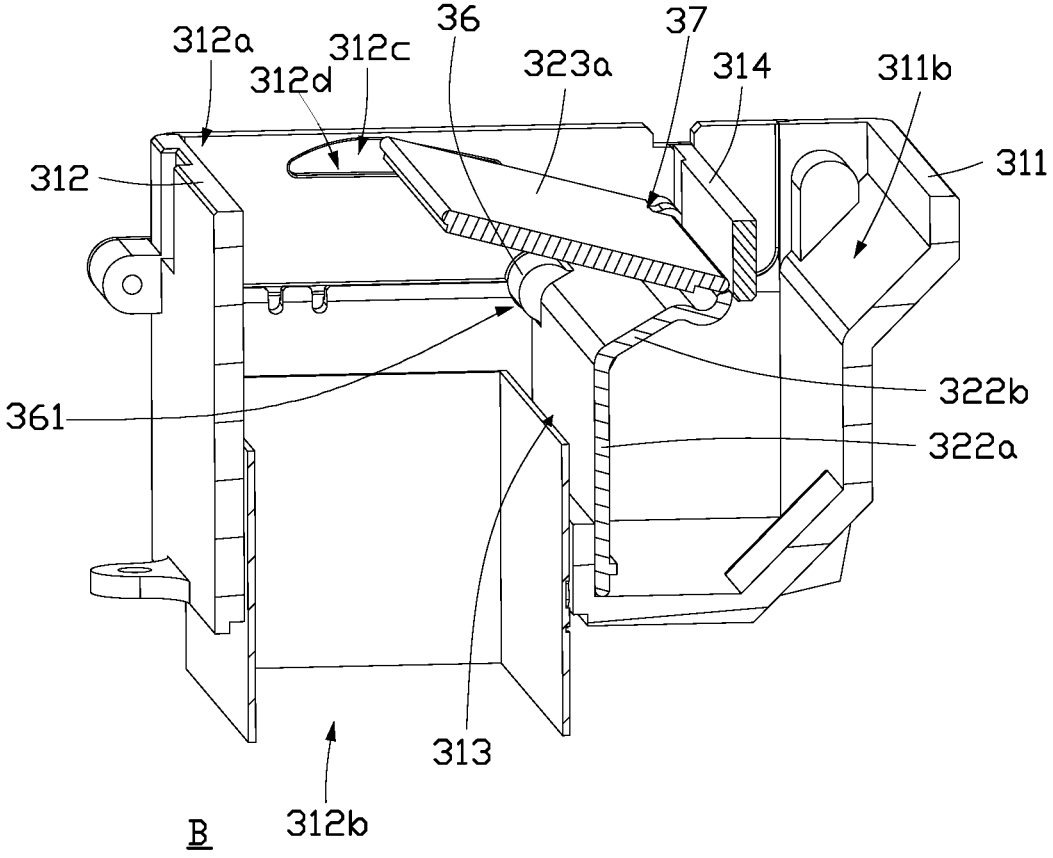
FIG. 7 is a cross-sectional view along a view line VII-VII of the switching valve in FIG. 6.

Referring to FIGS. 6 and 7, in the second circulation state B, the first sealing member 322 does not seal the first outlet 311*b* but does seal the through hole 313, and the second sealing member 323 does not seal the second inlet 312*a*. The airflow in the first flow path 11 or the second flow path 21 can exchange with the airflow the external environment. The airflow from the second flow path 21 can enter the first chamber 311 via the first inlet 311*a* and be discharged to the external environment via the first outlet 311*b*. Meanwhile, the external airflow can enter the second chamber 312 via the second inlet 312*a*, and then flow to the first flow path 11 via the second outlet 312*b*. In the second circulation state B, there is a continuous flow of fresh air from the external environment into the clothes dryer 100.

Referring to FIGS. 5 and 7, in this embodiment, the first sealing member 322 is generally L-shaped. The first sealing member 322 includes a first sealing plate 322*a* and a second sealing plate 322*b*. The first sealing plate 322*a* is connected to the second sealing plate 322*b* to form a limiting space 322*c*. The driving member 321 drives the first sealing plate 322*a* and the second sealing plate 322*b* to rotate around a linear connection area between the first sealing plate 322*a* and the second sealing plate 322*b*. The first sealing plate 322*a* is used to selectively cover the first outlet 311*b*, and the first sealing plate 322*a* and the second sealing plate 322*b* are used to selectively cover the through hole 313. The second sealing member 323 can be rotatably connected to one side of the second sealing plate 322*b* away from the first sealing plate 322*a*. Referring to FIG. 5, in the first circulation state A, the first sealing plate 322*a* seals the first outlet 311*b*, and the first sealing plate 322*a* and the second sealing plate 322*b* do not seal the through hole 313. Referring to FIG. 7, in the second circulation state B, the first sealing plate 322*a* does not seal the first outlet 311*b*, and the first sealing plate 322*a* and the second sealing plate 322*b* cooperatively seal the through hole 313.

Referring to FIGS. 5 and 7, in this embodiment, the air-exchange chamber 31 further includes a limiting plate 314. The limiting plate 314 is disposed on the first outlet 311*b*. The limiting plate 314 faces the limiting space 322*c*. In the first circulation state A, the limiting plate 314 supports the first sealing plate 322*a* to prevent the first sealing plate 322*a* from continuing to rotate. In the second circulation state B, the limiting plate 314 supports the second sealing plate 322*b* to prevent the second plate 322*b* from continuing to rotate. Thus, the limiting plate 314 can be used to restrict a rotation range of the first sealing member 322.

Referring to FIGS. 2, 4, 5, and 7, in this embodiment, the clothes dryer 100 further includes a sensor 40 and a controller 41 connected to the sensor 40. The controller 41 also connected to the driving member 321. The a sensor 40, such as a micro switch, can be placed on the limiting plate 314. When the sensor 40 detects that the first sealing member 322 or the second sealing member 323 is in a preset position, the controller 41, such as Programmable Logic Controller, controls the driving member 321 to stop working. This prevents the first sealing plate 322*a* and the second sealing plate 322*b* from continuing to rotate, thereby ensuring a stable switch between the first circulation state A and the second circulation state B of the switching valve 30. In other embodiments, the sensor 40 can also be placed on an opposite inner wall of the second chamber 312 or the second sealing member 323 to detects whether the first sealing member 322 or the second sealing member 323 is in a preset position.

Referring to FIG. 6, in this embodiment, the second sealing member 323 includes a third sealing plate 323*a* and a guiding post 323*b*. The third plate 323*a* movably covers the second inlet 312*a*. The guiding post 323*b* is positioned on an opposite side of the third sealing plate 323*a*. The second air chamber 312 is recessed on the opposite side of the third sealing plate 323*a* to form a guiding groove 312*c*. The guiding post 323*b* is movably received in the guiding groove 312*c* to limit a range of movement of the third sealing plate 323*a*. The guiding groove 312*c* is crescent-shaped, and the shape of the guiding groove 312*c* is determined by the projection of an area 312*d* swept by the third sealing plate 323*a* during movement on an inner side of the second air chamber 312.

Referring to FIGS. 4 and 5, in this embodiment, the first sealing member further includes two first assembly portions 33, which are spaced apart at one end of the second sealing plate 322*b* facing the third sealing plate 323*a*. The second sealing member 323 further includes two second assembly portions 34, which are positioned corresponding to the first assembly 33. The sealing assembly 32 further includes a rotating pin 37. The rotating pin 37 passes through the first assembly portion 33 and the second assembly portion 34, allowing the third sealing plate 323*a* to rotate relative to the second sealing plate 322*b*. In other words, a hinged connection is achieved between the second sealing plate 322*b* and the third sealing plate 323*a*.

Referring to FIG. 5, in this embodiment, the sealing assembly 32 further includes a rotating assembly portion 36. The rotating assembly portion 36 is positioned at a connecting area between the first sealing plate 322*a* and the second sealing plate 322*b*. A drive shaft 321*a* of the driving member 321 is connected to the rotating assembly portion 36. The rotating assembly 36 defines a square groove 361. A cross-sectional shape of the drive shaft 321*a* is square, allowing the drive shaft 321*a* to be inserted into the square groove 361. When the drive shaft 321*a* rotates, the rotating assembly 36 rotates with the drive shaft 321*a*, thereby driving the first sealing member 322 to rotate. In at least one embodiment, the driving member 321 is an electric motor.

Figure 3A:
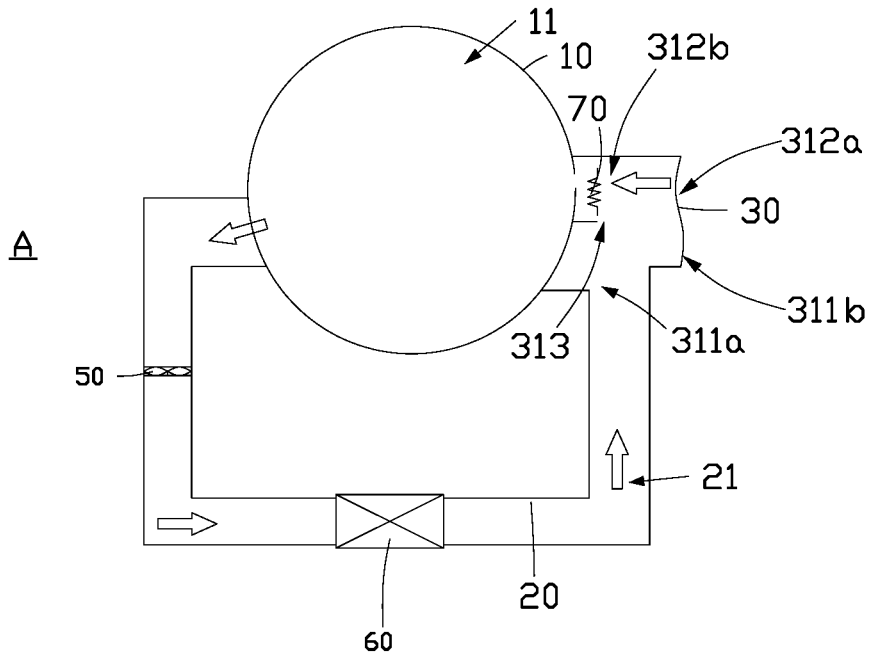
FIG. 3A is a diagrammatic view of the clothes dryer in FIG. 2 in a first circulation state.
Figure 3B:
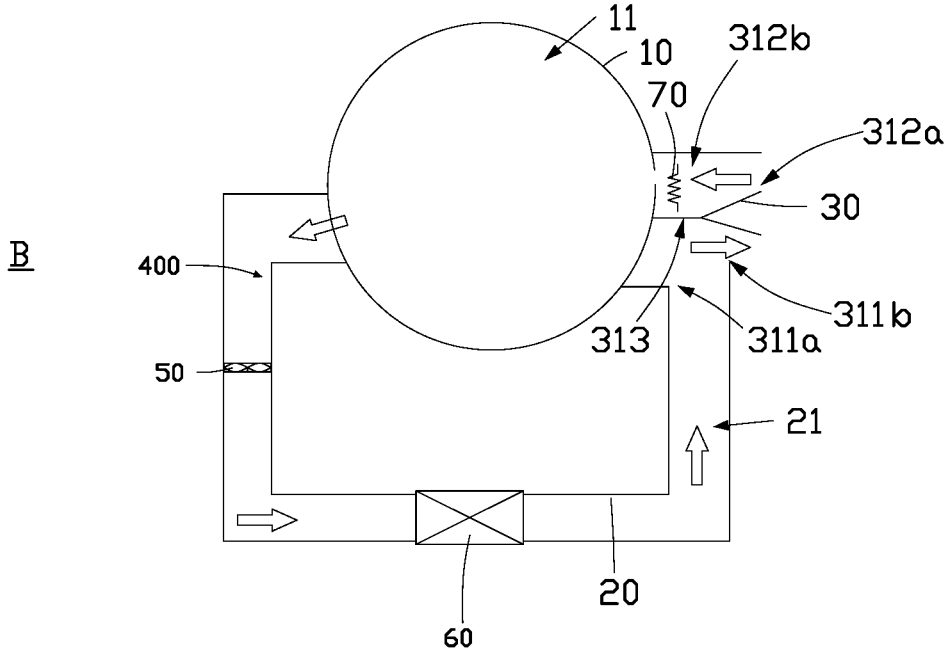
FIG. 3B is a diagrammatic view of the clothes dryer in FIG. 2 in a second circulation state.

Referring to FIGS. 3A and 3B, in this embodiment, the flow guiding component 20 also includes a fan 50, which is positioned inside the second flow path 21, and is used to drive air from the flow path 11 into the second flow path 21, thereby facilitating the drying of wet clothing inside the first flow path 11.

Referring to FIGS. 3A and 3B, in this embodiment, the flow guiding component 20 further includes a dehumidifier 60. The dehumidifier 60 is positioned inside the second flow path 21, and is used to reduce the air humidity inside the second flow path 21, thereby speeding up the drying of clothing inside the first flow path 11.

Referring to FIGS. 3A and 3B, in this embodiment, the flow guiding component 20 further includes a heater 70, which is positioned between the second inlet 312*a* and the first flow path 11. The heater 70 is used to heat the air entering the first flow path 11.

Even though information and advantages of the present embodiments have been set forth in the foregoing description, together with details of the structures and functions of the present embodiments, the disclosure is illustrative only. Changes may be made in detail, especially in matters of shape, size, and arrangement of parts within the principles of the present exemplary embodiments, to the full extent indicated by the plain meaning of the terms in which the appended claims are expressed.

What is claimed is:

1. A clothes dryer comprising:

a drum having a first airflow path;

a flow guiding component having a second airflow path, the first airflow path in communication with the second airflow path; and a switching valve disposed between the drum and the flow guiding component, wherein the switching valve comprises:

an air-exchange chamber comprising a first chamber and a second chamber, the first chamber is provided with a first inlet in communication with the second airflow path and a first outlet in communication with an ambient environment, the second chamber is provided with a second inlet in communication with the ambient environment and a second outlet in communication with the first airflow path, and a through hole is disposed between the first chamber and the second chamber; and a sealing assembly comprising a driving member, a first sealing member, and a second sealing member, wherein the driving member is connected to the first sealing member and configured to drive the first sealing member to rotate, the second sealing member is pivotally connected to the first sealing member, the first sealing member is configured to selectively cover the first outlet and the through hole, and the second sealing member is configured to movably cover the second outlet;

wherein the clothes dryer is in a first circulation state or a second circulation state, in the first circulation state, the first sealing member seals the first outlet and does not seal the through hole, and the second sealing member seals the second inlet, and in the second circulation state, the first sealing member does not seal the first outlet and seals the through hole, and the second sealing member does not seal the second outlet.

2. The clothes dryer of claim 1, wherein the first sealing member comprises a first sealing plate and a second sealing plate connected to the first sealing plate, the first sealing plate is configured to movably cover the first outlet, and the first sealing plate and the second sealing plate are configured to movably cover the through hole.

3. The cloth dryer of claim 2, wherein the second sealing member is pivotally connected to one side of the second sealing plate opposite to the first sealing plate.

4. The cloth dryer of claim 2, wherein the driving member is configured to drive the first sealing plate and the second sealing plate to rotate around a linear connection area between the first sealing plate and the second sealing plate.

5. The clothes dryer of claim 2, wherein the second sealing member comprises a third sealing plate, and the third sealing plate is configured to movably cover the second outlet.

6. The clothes dryer of claim 5, wherein the second sealing member further comprises a guiding post connected to the third sealing plate, the second chamber defines a guide groove, and the guiding post is movably received in the guide groove.

7. The clothes dryer of claim 5, wherein the guiding groove is defined by a projection of an area swept by the third sealing plate during a movement on an inner side of the second chamber.

8. The clothes dryer of claim 7, wherein the guiding groove is crescent-shaped.

9. The clothes dryer of claim 2, wherein the second sealing plate is hinged with the third sealing plate.

10. The clothes dryer of claim 9, wherein the second sealing plate is provided with two first assembly portions spaced apart from each other, the third sealing plate is provided with two second assembly portions spaced apart from each other, each of the two first assembly portions faces a respective one of the two second assembly portions, the sealing assembly further comprises a rotating pin, and the rotating pin passes through the two first assembly portions and the two second assembly portions.

11. The clothes dryer of claim 2, wherein the sealing assembly further comprises a rotating assembly portion, the rotating assembly portion is positioned at a connecting area between the first sealing plate and the second sealing plate, and the driving member is connected to the rotating assembly portion.

12. The clothes dryer of claim 11, wherein the rotating assembly defines a square groove, and a drive shaft of the driving member is inserted into the square groove.

13. The clothes dryer of claim 2, wherein the first sealing plate and the second sealing plate cooperatively define a limiting space, the air-exchange chamber further comprises a limiting plate, and the limiting plate is disposed on the first outlet and faces the limiting space.

14. The clothes dryer of claim 1, wherein the first inlet is staggered from the first outlet.

15. The clothes dryer of claim 1, wherein the second inlet is opposite to the second outlet.

16. The clothes dryer of claim 1, wherein the first outlet and the second inlet are arranged side by side.

17. The clothes dryer of claim 1, further comprising a fan, wherein the fan is disposed within the second airflow path, and the fan is configured to drive air from the first airflow path into the second airflow path.

18. The clothes dryer of claim 1, further comprising a dehumidifier, wherein the dehumidifier is disposed within the second airflow path, and the dehumidifier is configured to reduce a humidity in the second airflow path.

19. The clothes dryer of claim 1, further comprising a heater, wherein the heater is disposed between the second inlet and the first airflow path, and the heater is configured to heat the air flowing into the first airflow path.

20. The clothes dryer of claim 1, wherein the driving member is an electric motor.

* * * * *